United States Patent [19]

Zouzoulas

[11] Patent Number: 4,953,681

[45] Date of Patent: Sep. 4, 1990

[54] COMPACT, LOW POWER GATE APPARATUS FOR COIN OPERATED MACHINES

[75] Inventor: John Zouzoulas, West Chester, Pa.

[73] Assignee: Mars Incorporated, McLean, Va.

[21] Appl. No.: 199,138

[22] Filed: May 26, 1988

[51] Int. Cl.[5] ..... G07F 9/04

[52] U.S. Cl. ..... 194/346; 379/150

[58] Field of Search ..... 194/346; 379/149, 150, 379/152

[56] References Cited

U.S. PATENT DOCUMENTS

| | | | |
|---|---|---|---|
| 1,206,958 | 12/1916 | Watling | 194/346 X |
| 2,283,396 | 5/1942 | Towne | 194/346 |
| 2,670,830 | 3/1954 | Hoyt | 194/346 |
| 3,837,454 | 9/1974 | Joeck . | |
| 3,948,377 | 4/1976 | Hayashi et al. | 194/346 X |
| 4,361,161 | 11/1982 | Johnson | 194/346 X |
| 4,534,459 | 8/1985 | Plesko . | |
| 4,538,719 | 9/1985 | Gray et al. . | |
| 4,782,937 | 11/1988 | Chen et al. | 194/346 |

FOREIGN PATENT DOCUMENTS

| | | |
|---|---|---|
| 0062972 | 10/1982 | European Pat. Off. . |
| 2133601 | 7/1984 | United Kingdom . |

*Primary Examiner*—F. J. Bartuska

*Attorney, Agent, or Firm*—Davis Hoxie Faithfull & Hoxie

[57] ABSTRACT

A compact, low power gate apparatus for use in coin operated machines, such as coin operated telephones, utilizes an inclined diverting surface and adjacent, coupled levers to decrease power requirements, multiply displacements and save space. A selectively energizable solenoid associated with a first lever moves the levers from a first to a second position when the solenoid is energized, and maintains them in their first position until the solenoid is energized again. A spring restores the levers to their first position when the solenoid is no longer energized and maintains the levers in their first position until the solenoid is energized again. The second lever has a coin diverting plate which is selectively positioned to divert a coin to a particular path or allow the coin to continue along the same path. The inclined diverting surface has an angle such that the component of force due to a falling coin impacting the surface is directed toward the pivot point of the second lever, decreasing the restoring force required to maintain the second lever in its first position, thereby decreasing the power requirements of the solenoid. The apparatus can reject coins in a passive mode and accept coins in an active mode. A microprocessor controls the selective energization of the solenoid by controlling a specially designed power supply and power application control circuit for low power operation from power supplied from a phone line.

26 Claims, 8 Drawing Sheets

COMPACT, LOW POWER GATE APPARATUS FOR COIN OPERATED MACHINES

FIELD OF THE INVENTION

The present invention relates generally to a gate apparatus for controlling the direction of travel of coins moving within a coin operated machine and, more particularly, to a compact, low power gate apparatus designed for use in a coin acceptor to be used with a coin operated machine, such as a coin operated telephone in which (1) the overall height of the coin acceptor and consequently the height of the gate, and (2) the power available to operate the gate are severely restricted.

BACKGROUND OF THE INVENTION

Coin operated machines, such as payphones, vending machines and pinball machines, typically utilize movable gates to direct coins within the machine. For example, a coin, determined to be genuine by coin testing sensors in a coin testing mechanism located within a coin operated machine, can be directed to a coin storage tube for storing coins of that denomination for change making, a cashbox for storage or to an escrow position from which coins can be returned to the customer if the customer decides not to use the machine, or is unable to do so. For example, if the user of a payphone is unable to complete a call he is attempting to make because the called party does not answer, his money is typically refunded from escrow. A counterfeit coin or slug, on the other hand, can be directed to a coin reject chute. Based on the information received from one or more coin test sensors, a control circuit controls the operation of one or more gates to achieve such ends.

In the past, solenoids with a moving core have been utilized to provide the force necessary to actuate the coin gates and spring biasing has been employed to restore the gates to their initial positions. Such solenoids, which are still widely used in vending machines, may have power requirements on the order of 30 watts. This power requirement has been met by connecting the solenoids to a source of line voltage or to a step-down transformer providing the power at a lower voltage. In either case, the electrical shock hazard implicit in such a high power requirement must be avoided by adequate electrical isolation, which adds complexity and cost to the machine.

U.K. patent No. 2,133,601, assigned to the assignee of the present application, describes an improved coin routing device comprising a coin routing member which is selectively movable for controlling the path of a coin. The passage of a control current through a conductor causes the coin routing member to move with respect to a magnet. The device is preferably operated by passing the control current through the conductor in a first direction to move the coin routing member from a first position to a second position and passing the control current through the conductor in the opposite direction to return the coin routing member to its first position.

Another low power coin routing gate apparatus is disclosed in U.S. Pat. No. 4,534,459, also assigned to the assignee of the present invention. This invention minimizes the electrical power required by energizing an electromagnet which attracts one arm of a pivoting gate thereby holding it in place and preventing it from pivoting only when a coin is to be accepted. The pivoting gate forms a part of a coin directing track along which coins roll on edge. When the electromagnet is energized, an acceptable coin rolls over the gate and continues along the accept path. If a coin is to be rejected, the electromagnet is not energized. Then, the weight of the coin on the gate causes the gate to rotate out from under the coin thereby allowing the coin to fall under the influence of gravity into a reject chute. A counterweight returns the gate to its initial position. In this application, no electrical power is required to do mechanical work. The only electrical power used is used to hold the gate in the accept position, and the specially designed gate requires only low power to hold it in this position.

Anritsu Corporation of Japan has developed a gate utilizing a single long lever arm which apparently requires a relatively low amount of power to operate. This gate includes a conventional coin directing member with a coin slot through which an acceptable coin passes when the gate is in its accept position. The directing member also has a coin blocking plate which diverts a counterfeit or otherwise rejected coin to a reject chute when the gate is in its reject position. The long lever arm results in a gate which has too great a height for certain applications and may result in timing problems if a customer credit signal is generated by use of a post-gate coin sensor. Such timing problems can arise because of the large distance between the last of the coin testing sensors and the post gate sensor. For example, the gate may not be able to move fast enough to reject a counterfeit coin which is inserted shortly after an acceptable coin. In addition, the longer lever arm occupies a large height, which may necessitate a taller coin acceptor than can be used in certain height restricted applications.

SUMMARY OF THE INVENTION

The present invention, in contrast to the prior art discussed above, utilizes a coupled lever system in a compact structure which eliminates timing and sizing problems and achieves low power operation. While these features may be desirable in any coin gate application, they are particularly well suited to applications such as coin acceptors for use in the retrofitting of existing coin operated telephones or for use in any payphone or other application in which there are severe physical height and electrical power constraints. A compact, low power gate apparatus for controlling the direction of travel of a coin moving in a coin operated machine according to the present invention comprises a solenoid with a fixed core, a means for controlling the solenoid, two adjacent, coupled levers and a restoring means. A first of the coupled levers has one arm which can be attracted by the solenoid to move the levers from a first position to a second position. In one embodiment, this first lever has an actuator arm having a magnetically attractable section which lies above a pole of the solenoid when the actuator arm is in a first reject position. The first lever is connected to a first pivot point. The actuator arm rotates from its first reject position when the solenoid is not energized to a second accept position when the solenoid is energized. A second of the coupled levers is acted upon by the restoring means to restore the levers to their first positions when the solenoid is not energized.

The second lever which includes a coin diverter, is secured to a second pivot, and is engaged by the first lever to which it is coupled so that movement of the actuator arm from the first to the second position rotates the second lever about the second pivot, thereby moving the coin diverter from the first reject position to the second accept position. The actuator arm and the gate are held in their second position for as long as the solenoid is energized. Thus, the coin diverter is selectively moved to direct a coin to the proper path. The coupling of the levers enables a small displacement by the arm attracted by the solenoid to be translated into a larger displacement by the coin diverter. It also allows the overall height of the gate to be substantially reduced. In the presently preferred embodiment, the coin diverter is located at or near the top of the gate assembly to reduce timing problems. Such a compact, low power gate apparatus used in a coin operated machine, such as a payphone, acts to direct coins in either of at least two or more directions such as to an escrow position, a coin return chute, or to a cashbox.

The coin diverter includes an inclined surface which directs a component of the force due to the impact of a falling coin toward the pivot point of the lever. This minimizes the moment which can be generated by the impact of the coin, tending to move the lever from its first to its second position. The restoring means acts to prevent any such movement unless the solenoid is energized. By decreasing the moment which can be generated, the force of the restoring means can also be decreased. Since the energized solenoid must overcome the moment of the restoring means when causing the levers to move to their second positions, decreasing the required restoring means decreases the power requirement of the solenoid as well.

In a payphone environment in which it is desirable to operate utilizing only phone line power, a specially designed control circuit is preferably utilized to ensure proper operation with very low power consumption.

DETAILED DESCRIPTION

Figure 1:
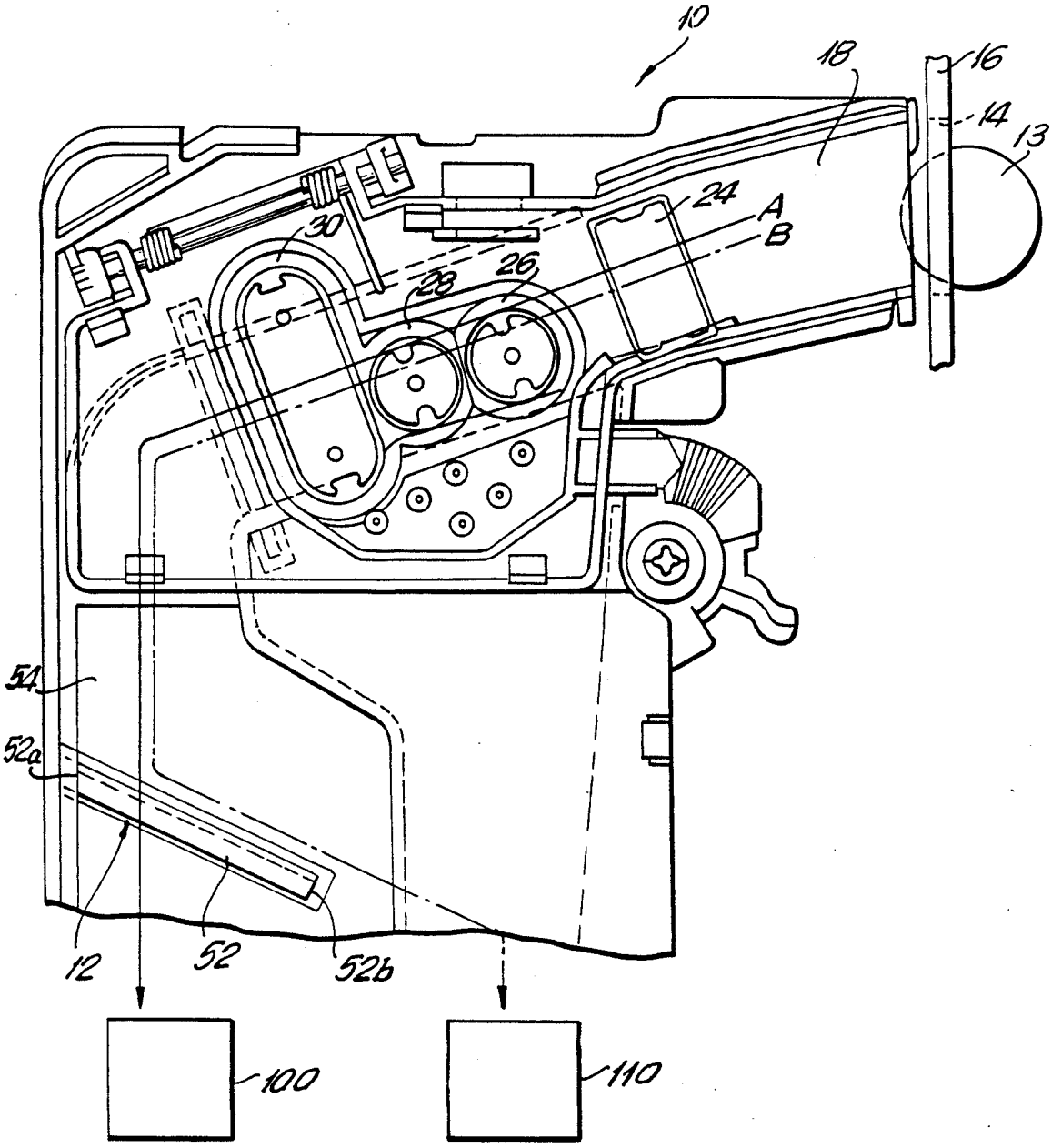
FIG. 1 shows a left side view of the top portion of a coin acceptor utilizing a compact, low power gate apparatus according to the present invention.

FIG. 1 shows the upper portion of a coin acceptor 10 suitable for use with a gate apparatus 12 according to the present invention. Coin acceptor 10 is preferably used in a coin operated machine, such as a coin operated telephone (not shown). The bottom portion of coin acceptor 10, which is cut away, serves to direct coins in a conventional manner to a cashbox or escrow 100 or a coin return slot 110 illustrated in block form. FIG. 1 illustrates the presently preferred physical relationship between the gate apparatus 12 and other parts of a coin acceptor designed for retrofitting presently existing coin operated telephones or for use in newly built coin operated telephones having internal specifications comparable to those of presently existing payphones. While the only part of gate 12 shown in FIG. 1 is a coin diverter plate 52, subsequent figures show further details.

Before discussing the specific details of gate 12, the operation of coin acceptor 10 will be briefly described. A coin 13 is shown in FIG. 1 being inserted through a slot 14 in the front panel 16 of a payphone (not shown). Coin 13 then passes into a coin entryway 18 of the coin acceptor 10. A preferred coin entryway which reduces jamming and the insertion of foreign matter is disclosed in U.S. Pat. Application Serial No. 188038, filed on Apr. 29, 1988, and assigned to the assignee of the present invention. That application is incorporated by reference herein. The coin 13 can roll, slide, or fall under the influence of gravity along several paths or passageways defined by front and rear walls and coin tracks supported by those walls. Paths A and B, shown in solid and dashed lines respectively in FIG. 1, lead past coin detection and testing sensors 24, 26, 28 and 30. Path A, the accept path, continues through the gate 12, as will be described in greater detail below, to the cashbox or escrow 100. For the coin 13 to follow path B, the reject path, it must be diverted by the gate 12 to the reject chute 110. Turning to the details of the sensors 24, 26, 28 and 30, which are positioned along the upper portions of coin pathways A and B, the sensor 24 detects the presence of a coin and can also detect the presence of foreign matter inserted into the entryway 18. A suitable sensing device for use as sensor 24 is described in U.S. Pat. No. 4,413,718, assigned to the assignee of the present invention. This sensor utilizes a light source and a detector on one side of a coin passage and a prism on the other so that coins and other objects are more reliably detected. Light emitted by the source is reflected by the prism to the detector, which detects a blockage of either the emitted or reflected light beam due to the passage of a coin or presence of foreign matter. The remaining sensors, 26, 28 and 30, test a variety of a coin's characteristics, such as its thickness, material and diameter, to determine its validity and its denomination. The details of these coin sensors are not part of the present invention, however, electronic coin sensors are preferred because they can be arranged in known fashion to present a relatively smooth coin passageway which is more readily cleaned and which is more resistant to jamming than the typical electromechanical sensing arrangement. By way of example, coin testing can be carried out in accordance with the techniques of one or more of the following U.S. Pat. Nos. 3,739,895; 3,870,137; 3,918,564; 3,918,565; 4,316,218; 4,462,513; 4,460,003; 4,461,365; 4,601,380; and 4,538,719; all of which are assigned to the assignee of the present invention. Outputs from the Coin sensors 24, 26, 28 and 30 are fed to a microprocessor (not shown) which under suitable software program control determines whether a coin should be accepted or rejected. The microprocessor produces control signals for controlling the operation of the gate 12.

Figure 2:
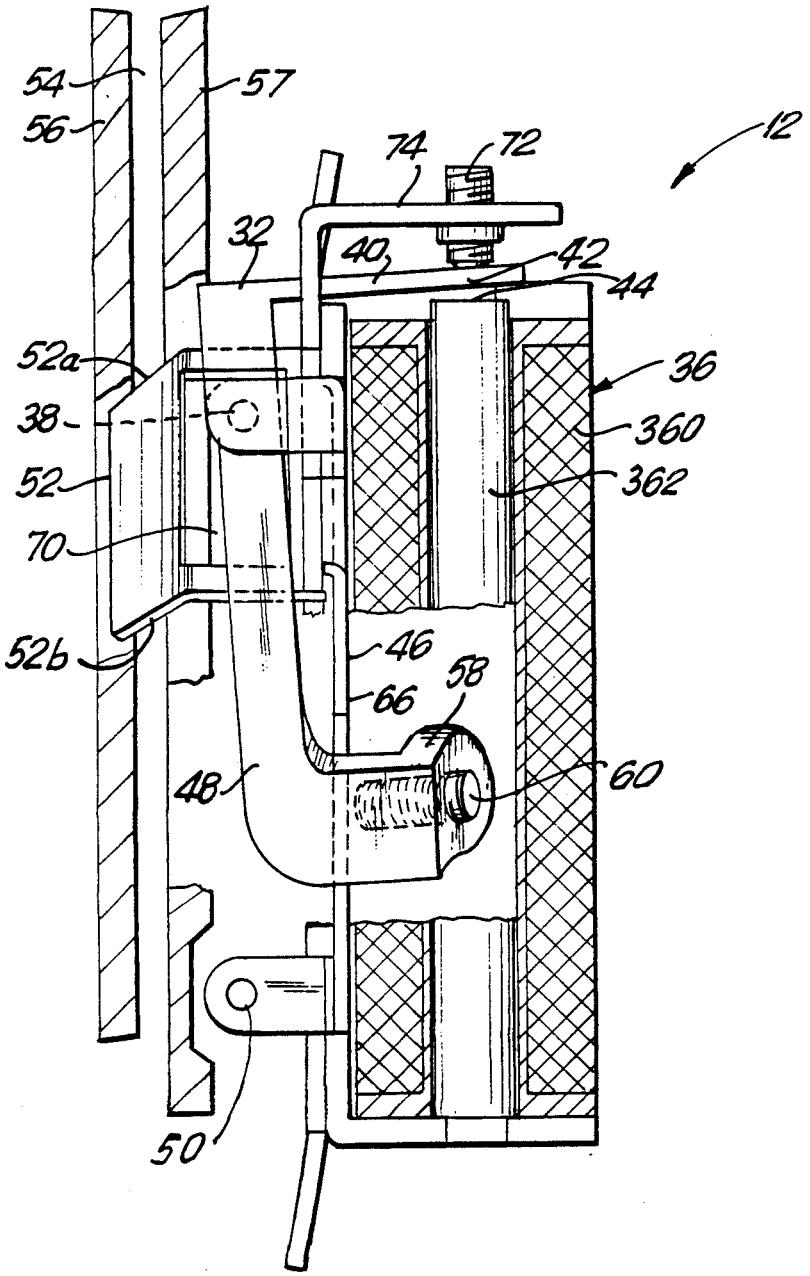
FIG. 2 shows a partially cut away, side view of the low power gate apparatus of FIG. 1, with the gate solenoid not-energized.
Figure 5:
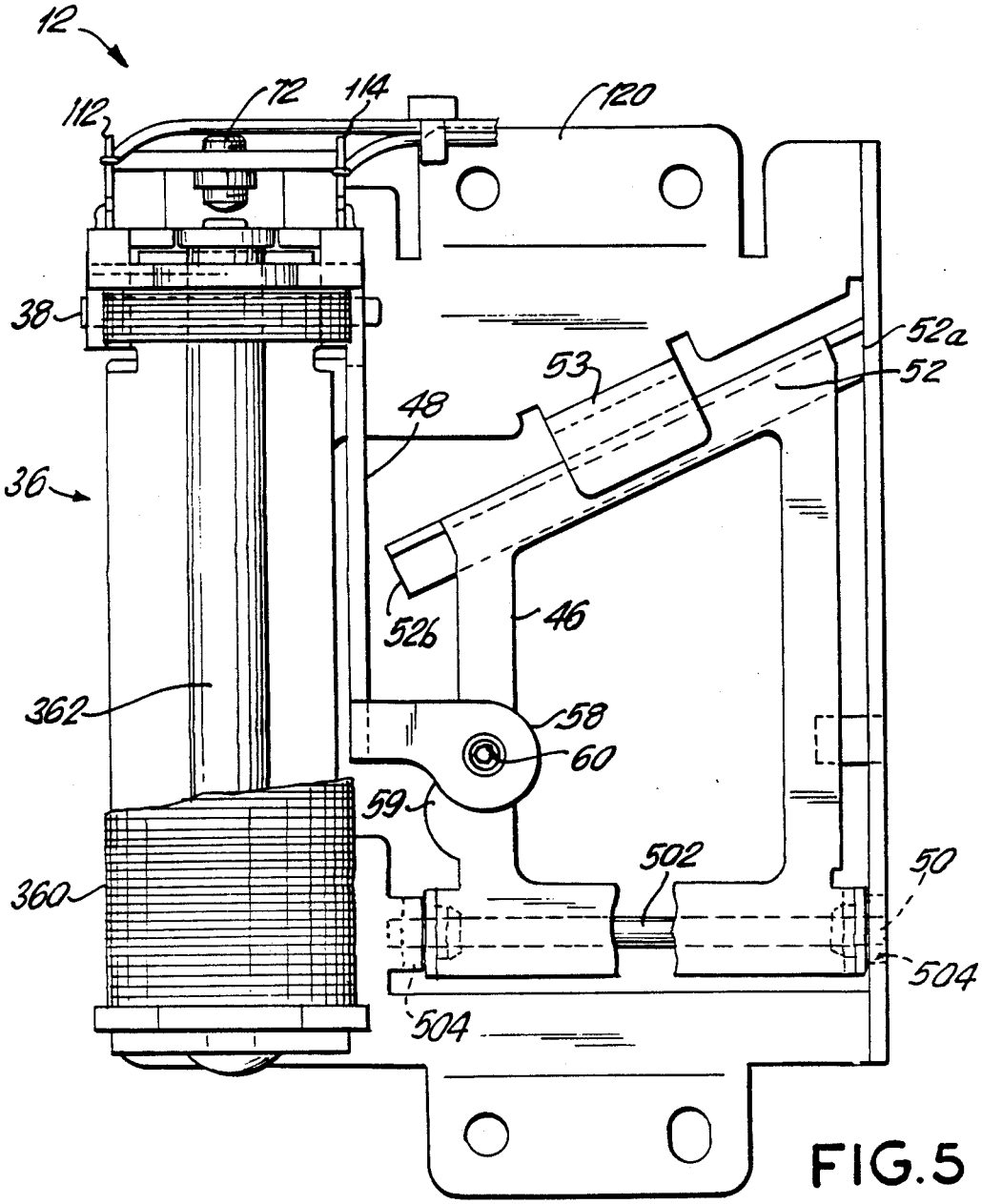
FIG. 5 is a back view of the gate of the present invention.
Figure 6:
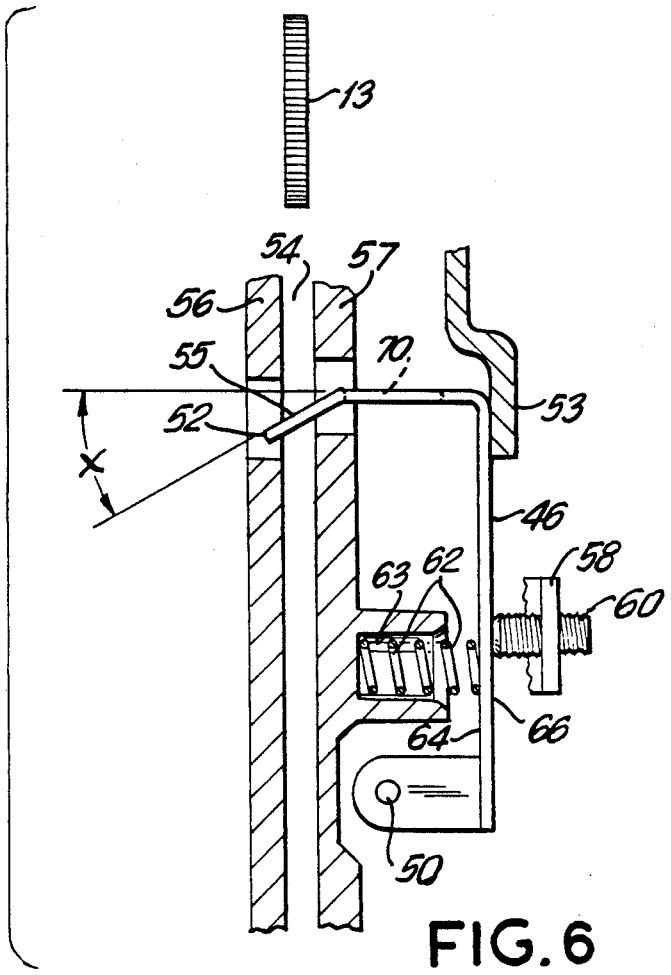
FIG. 6 is a simplified side view of gate of the present invention, with the solenoid and actuator arm removed for illustrative purposes.
Figure 7:
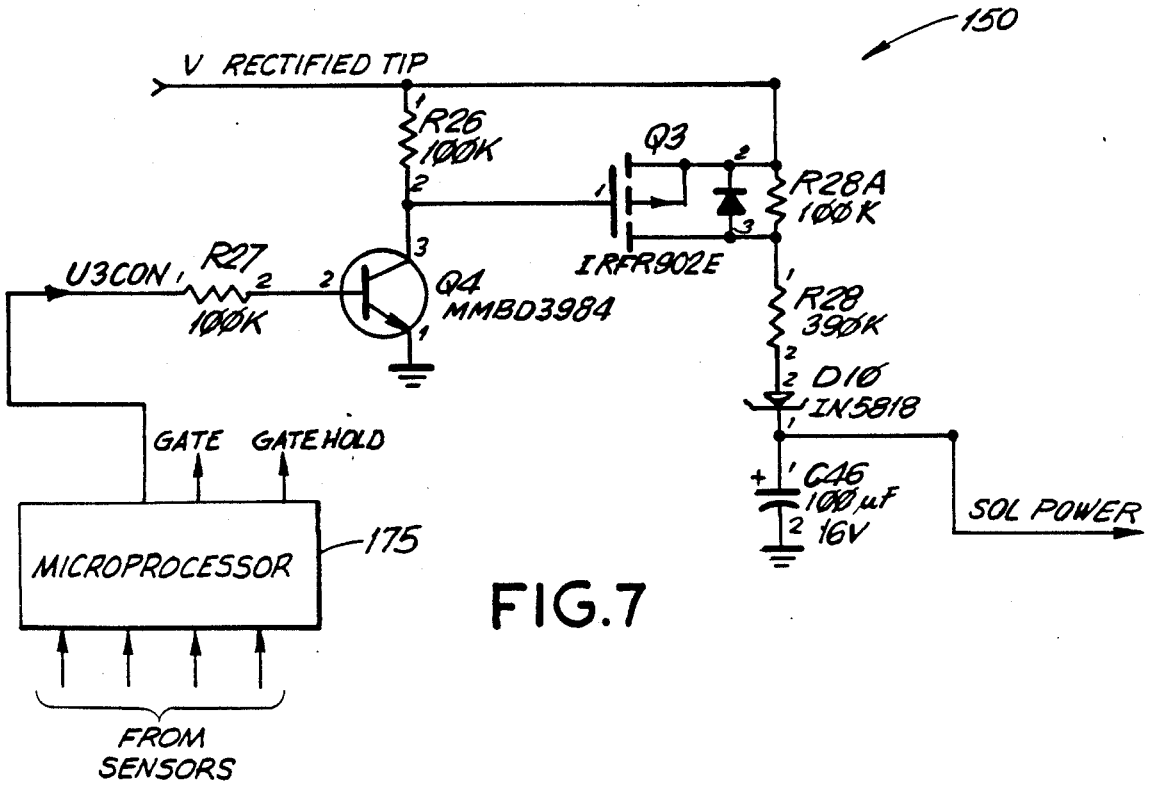
FIG. 7 is a schematic of a power supply for supplying gate operating power.
Figure 8:
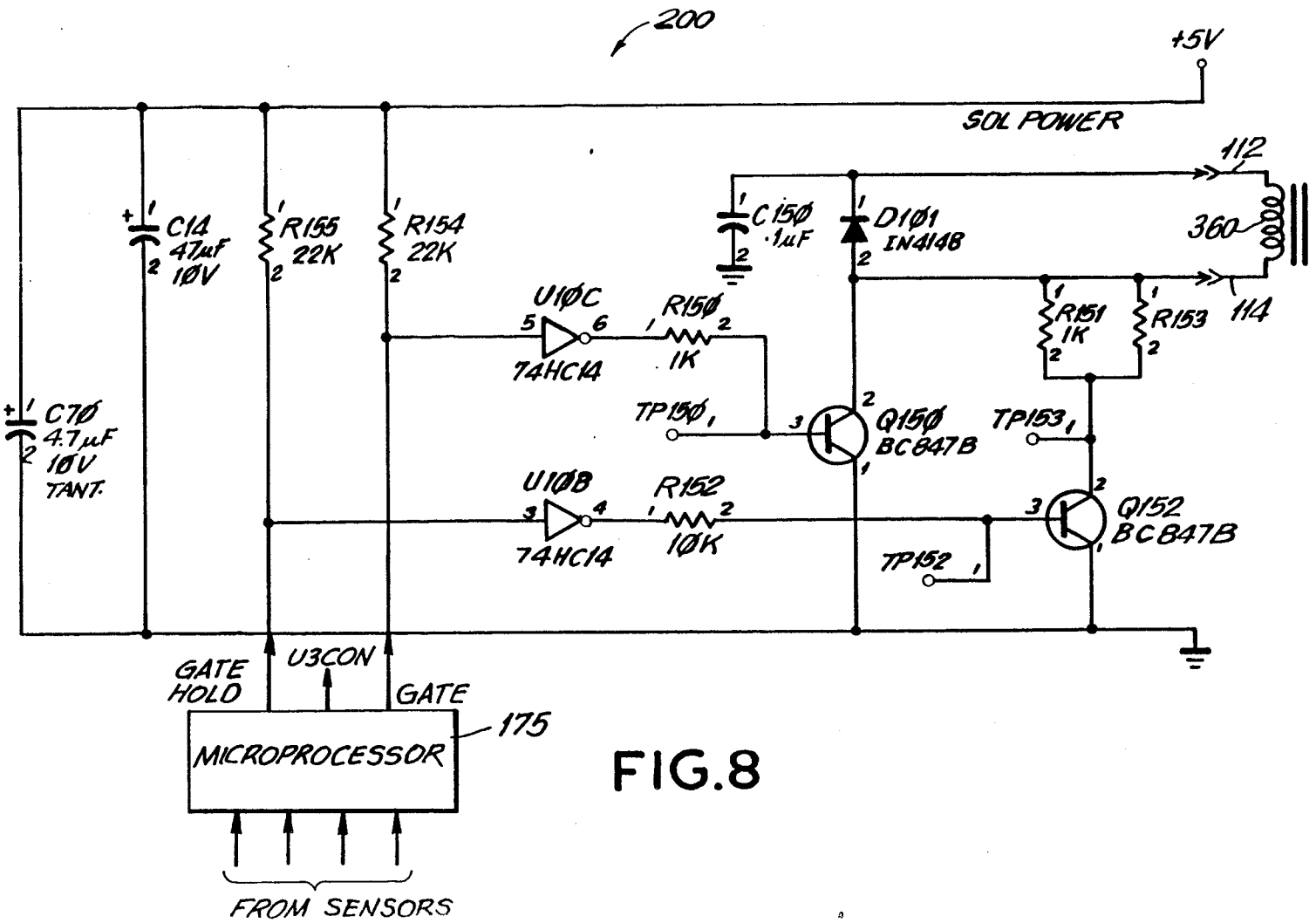
FIG. 8 is a schematic of a control circuit for controlling the delivery of power to the gate solenoid.

Turning to the details of the gate 12, FIGS. 2–6 illustrate various physical aspects of gate 12, and FIGS. 7 and 8 illustrate a presently preferred power supply !50 and control circuit 200 for controlling the operation of the gate 12. FIG. 2 illustrates the compact, low power gate apparatus of the present invention in its first position, also referred to as the passive reject position. In this position, the coin diverter 52 is located as shown in FIG. 2 so that a solid surface extends across coin passageway 54. As best seen in FIG. 1, in the reject position, a coin falls through the passageway 54, lands on the coin diverter 52, and then rolls along diverter 52 to its end 52*b*, where it falls off the diverter into the reject chute 110. The gate 52 is shown to have a first angle of inclination along the coil passageway 54. When diverter 52 is in the reject position, a selectively energizable solenoid 36 which controls the diverter's position is in an unenergized state. The solenoid 36 controls the movement of diverter 52 as follows. The solenoid 36 comprises a coil 360 wound on a bobbin 362 which is fitted over a core pin (not shown). A first lever, the actuator arm 32, is connected to and pivots about a first pivot 38. An upper part 40 of actuator arm 32 includes a magnetically attractable region 42 which is shown in FIG. 2 directly above pole 44 of the solenoid 36. The magnetically attractable region can be confined to the area above the pole 44, or can encompass a larger part or the whole of the actuator arm 32.

Figure 3:
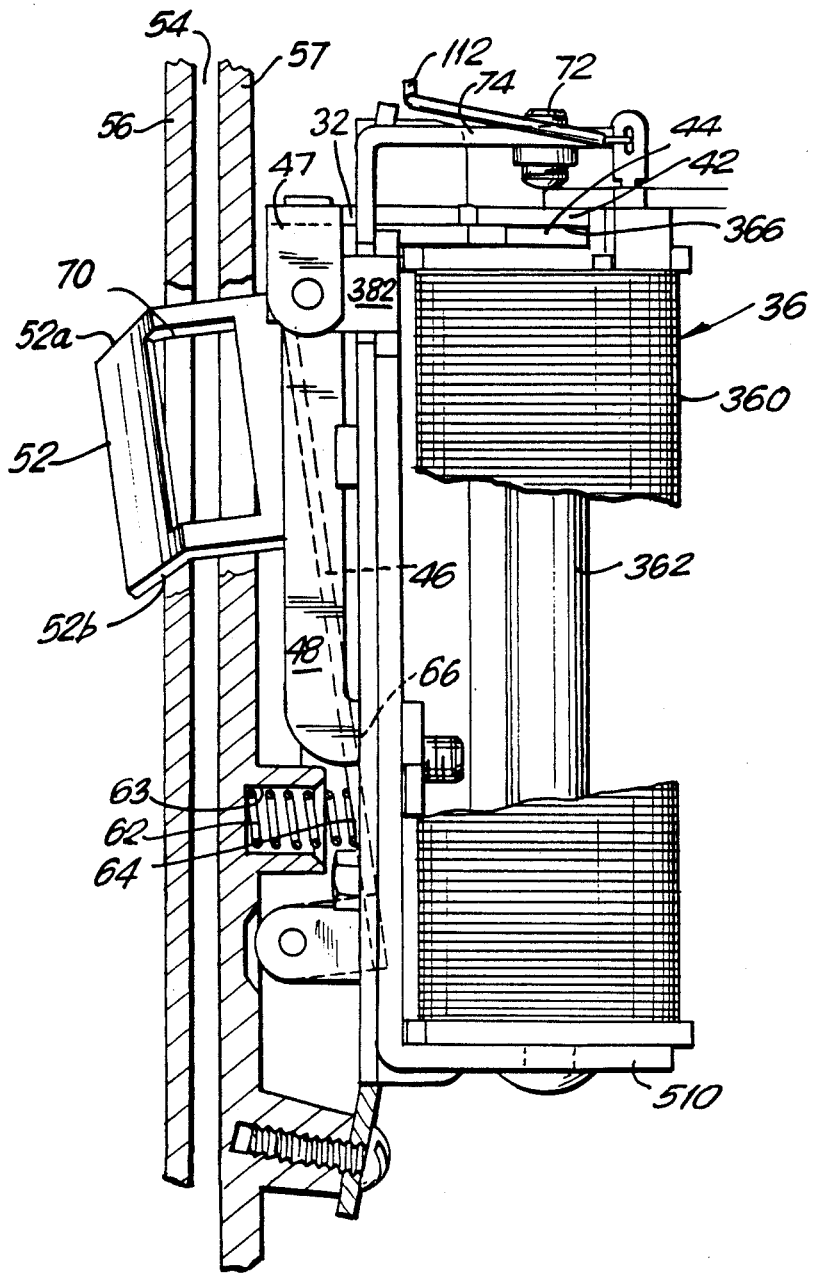
FIG. 3 shows a second side view of the gate apparatus of the present invention with the gate solenoid energized.

As shown in FIG. 3, when the solenoid 36 is energized the magnetically attractable region 42 is pulled against the pole 44 of solenoid 36 causing the diverter 52 to move to the position shown in FIG. 3. The details of how this movement is produced will be discussed further below. In the position shown in FIG. 3, the accept position, a slot 70 in the diverter plate 52 is aligned with the coin passageway 54. As best seen in FIG. 1, with the slot 70 in the accept position, a coin falls through passageway 54, passes through slot 70 and travels to the cashbox or escrow 100. Thus, the gate 12 directs the coin along accept path A.

Figure 4:
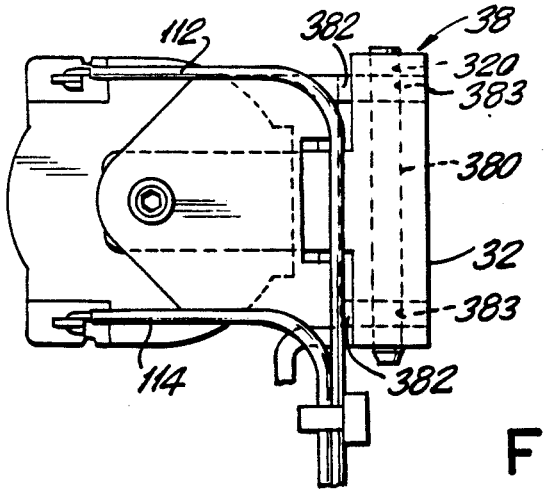
FIG. 4 is a top view illustrating the relationship of the solenoid, actuator arm and first pivot of the gate of the present invention.

FIG. 4 is a top view of the solenoid 36 and illustrates details of certain features which are obscured in the side views of FIGS. 2 and 3. The first pivot 38 is shown to comprise a pin 380 which passes through openings 320 in the actuator arm 32, as well as openings 383 through ear pieces 382 which are bent out of a coil bracket 510 used to mount the coil within coin acceptor 10. Side views of ear pieces 382 and coil bracket 510 are shown in FIG. 3.

Returning to FIG. 2, a second lever 46 which carries the coin diverter 52 is seen to lie adjacent to a lower arm 48 of actuator part 32, and is operably coupled to the actuator arm 32. The second lever 46 is pivotally connected to a second pivot 50, about which the second lever 46 can rotate. The second pivot 50 is best seen in FIG. 5, which is a back view of the gate apparatus 12. Second pivot 50 comprises a pin 502 running through the ends of lever 46, as well as through two ears 504 which are bent out of a base plate 120. The base plate 120 provides a mounting means for the parts of the gate and a support for connection to the remainder of the coin acceptor 10.

At the other end of the lever 46 is located coin diverter 52 which is shown as a coin diverting plate. As discussed above, the presently preferred coin diverter 52 is a diverter plate having a coin slot 70 and an inclined surface 55 angled along the coin path B, as shown in FIG. 1, which can be aligned to direct a coin by either allowing it to pass through the slot or to be directed by the inclined surface. It will be readily recognized by men of ordinary skill in the art that a wide variety of other coin diverting arrangements might also be suitably employed in gate apparatus according to the present invention. As is seen in FIGS. 2, 3, 5 and 6, the coin diverting plate 52 is located proximate the top of the solenoid 36 and the upper arm 47 part 40 of actuator arm 32, providing a compact structure. In addition, the coin diverting plate is close enough to the sensors 26–30 shown in FIG. 1 to help avoid timing problems which may occur when coins are inserted rapidly one after the other.

Figure 9:
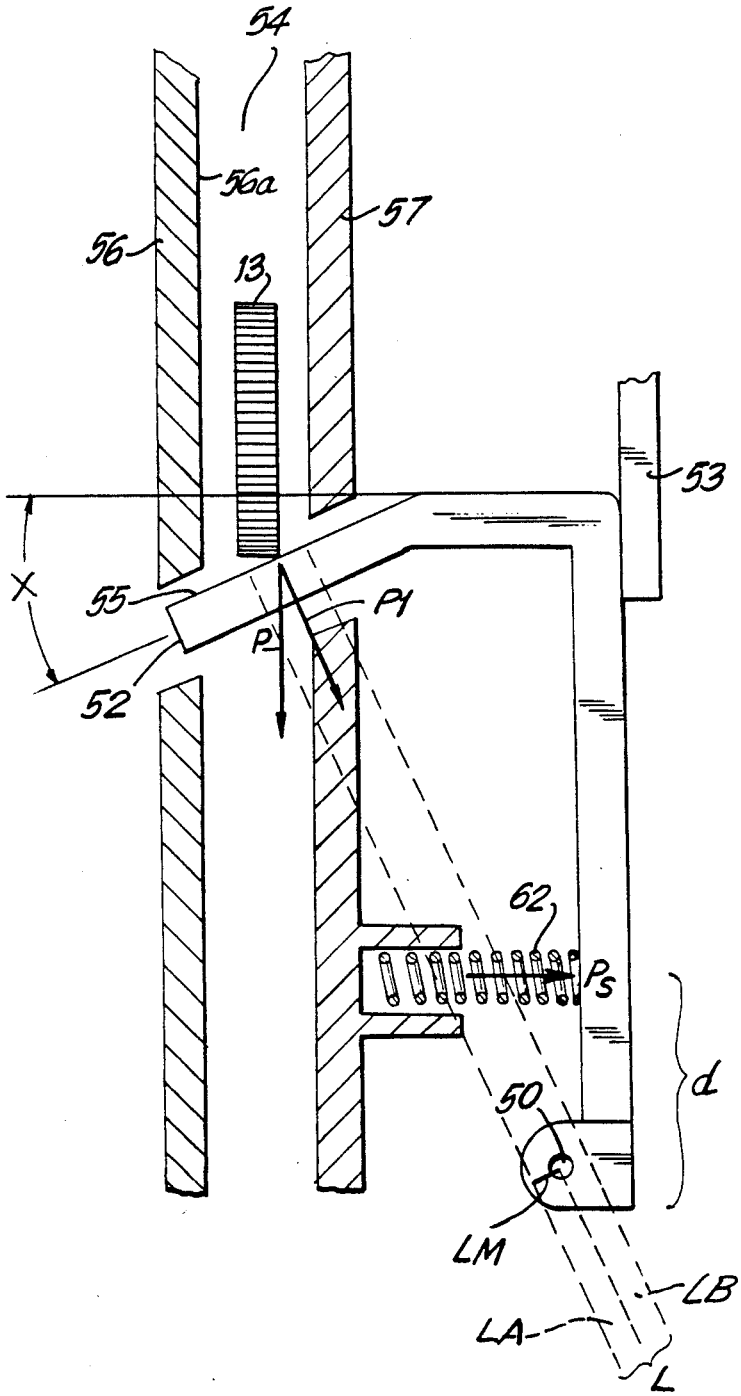
FIG. 9 is a partially cut away view of the gate apparatus of the present invention in the reject position, showing the forces exerted by a falling coin impacting the diverting plate.
Figure 10:
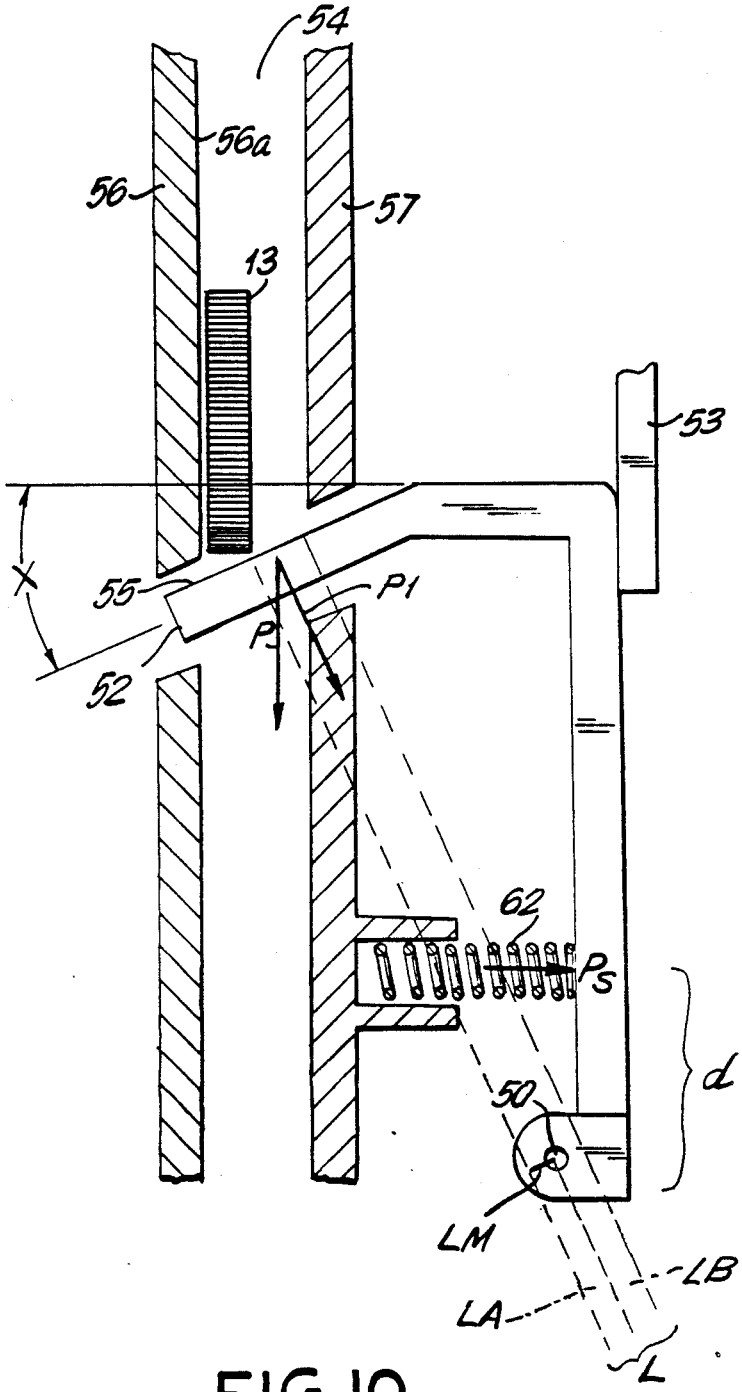
FIG. 10 is a partially cut away view of the gate apparatus of the present invention showing the position of a coin after impacting the diverting plate.

Additional features of the presently preferred coin diverting plate 52 are best seen in FIGS. 2, 9 and 10. In these figures, it is seen that the coin diverting plate 52 has a second angle of inclination toward the wall 56 is also at an angle X toward wall 56, shown in FIGS. 6, 9 and 10, which is preferably approximately 30°.

Returning to the linkage of actuator arm 32 and second lever 46, as best seen in FIGS. 2 and 5, the lower part 48 of the actuator arm 32 engages the second lever 46 through an extension or flap 58 of the actuator arm 32, which overlaps the second lever 46. A second view of this operative coupling is shown in FIG. 6, in which the solenoid 36 and the bulk of actuator arm 32 are not shown. As seen in FIG. 5, the extension or flap 58 extends perpendicular to the longitudinal axis of solenoid 36, and as seen in FIG. 5, actually contacts the lever 46 through an adjustable set screw 60. Set screws 60 and 74 allow gate 12 to be readily adjustable to compensate for manufacturing tolerances of the parts.

In FIGS. 3 and 6, a resilient restoring means, spring 62, is shown. Spring 62 sits in a recess 63 in wall 57 of coin acceptor 10. Spring 62 engages the side 64 of lever 46 opposite the side 66 contacted by set screw 60. This spring 62 provides a force opposing its compression due to movement of the lever 46. The spring 62 is not shown in FIG. 2 in order to better illustrate other elements of gate 12. The spring 62 cannot be seen in the view of FIG. 5, but it is located beneath round 59 of lever 46.

The overall operation of the gate 12 will now be described before turning to details of preferred power supply and control circuits for controlling the gate 12. The actuator arm 32, the lever 46, and coin diverter 52 are in their first positions when the solenoid 36 is not energized. The first position shown in FIG. 2 corresponds to a passive reject mode in which coins are rejected with no power being applied to the solenoid 36. FIG. 3 shows the actuator arm 32, the lever 46, and diverter 52 in their second positions when the solenoid 36 is energized or active. The actuator arm 32 is attracted toward the solenoid 36 and the coin diverter 52 is moved to its accept position. Here, the opening 70 is aligned with the coin passageway 54 between coin acceptor walls 56 and 57 and a coin moving in passageway 54 must pass through the opening 70 and continue along the accept path A. This is the active, accept mode. In the preferred embodiment, no power is supplied to the gate apparatus 12 when it is in its passive, reject mode. While this passive, reject configuration is preferred, it would be possible to switch the active and passive modes such that the gate would accept coins in the passive mode and reject coins in the active mode.

As the solenoid 36 is energized, the magnetically attractable part 42 of the actuator arm 32 is attracted to the solenoid 36, rotating the lower part 48 of the actuator arm 32 about the first pivot 38. This rotation causes set screw 60 to push against lever 46, rotating the lever 46 around the second pivot 50. This rotation in turn moves the coin diverting plate 52 from the first position shown in FIG. 2 to the second position shown in FIG. 3, aligning the opening 70 in the diverting plate 52 with the coin passageway 54. An accepted coin then passes through the opening 70.

In the present invention, the advantages of a lever are utilized by coupling two adjacent levers instead of using one, As shown in FIGS. 2–3, for example, the adjacent levers substantially overlap each other. actuator arm 32 results in a greater displacement of the lower part 48 of actuator arm 32. This movement in turn is translated to the lower part of lever 46, where the second set screw 60 engages lever 46. The coin diverting plate 52, located at the end of lever 46, is farther from the pivot point 50 than the set screw 60 and moves an even greater distance, which is sufficient for the coin diverting plate 52 to function. By using two coupled levers, a small displacement caused by the solenoid 36, requiring relatively little power, is translated to a sufficient displacement of the coin diverting plate 52, while the overall apparatus still occupies a relatively small height. In addition, the coupled levers of the present invention enable the coin diverting plate 52 to be positioned near the top of solenoid 36 and consequently close enough to the sensors 24, 26, 28, and 30 to avoid the timing problems which may be presented by a long or single lever arm arrangement. In a preferred embodiment, a displacement of the upper part 40 of the actuator arm 32 of approximately 1 mm translates to a displacement of the coin diverting plate 52 of approximately 5 mm.

After a sufficient amount of time for the inserted coin to pass through the slot 70 power to the solenoid 36 is shut off by the microprocessor as discussed below. Power is not applied to gate 12 again until another acceptable coin is inserted.

The spring 62 shown in FIG. 6, for example, is compressed by round 59 of lever 46, shown in FIG. 5, when gate 12 is in its accept position, exerting a sufficient force to return lever 46 and actuator arm 32 to their reject positions when the solenoid 36 is not energized. The lever 46 is pressed against the stop 53, as shown in FIG. 6, and actuator arm 32 rotates until its first part 40 is stopped by a set screw 72 in bracket 74, as seen in FIG. 2. The set screw 72 is adjustable so that the magnetically attractable portion 42 of the actuator ar 32 does not move beyond the most effective range of the magnetic force of the solenoid 36. A very thin magnetic insulator 366, shown in FIG. 3, is placed above the top of the pole 44 of the solenoid 36, to prevent residual magnetism from retaining actuator arm 32 in its accept position when power to the solenoid is turned off. This preferred arrangement results in a quick release of gate 12 from its accept position which again tends to reduce timing problems.

The spring 62 has a particular spring constant and is compressed a particular distance by the lever 46 in its second position such that the moment of the restoring force exerted by the spring 62 on the lever 46, tending to return the lever 46 and the actuator arm 32 to their first positions, is less then the moment of the magnetic force exerted by the energized solenoid 36 on the magnetically attractable region 42 of actuator arm 32. When no magnetic force is exerted, the spring 62 rotates the lever 46 and the actuator arm 32 about their pivot points, restoring them to their first positions and maintaining them in their first position until the solenoid 36 is again energized.

To maintain the lever 46 in its first position under the impact of a coin 13 falling on the coin diverting plate 52, the spring 62 is compressed and will exert a force P5 upon the lever 46 when the lever is in its first position FIGS. 9 and 10 show the effect of a coin 13 falling down the coin track 54 and impacting the inclined surface 55 of the coin diverting plate 52. The force of impact P generates the force P1, normal to the inclined surface 55. The component force P1 can generate a moment on the lever 46, tending to rotate it about the second pivot point 50. If the moment is directed counterclockwise, it will tend to rotate the lever 46 from its first, reject position, to its second, accept position This could align the opening 70 with the coin track 54 and allow the coin 13, which should be diverted to a reject chute along path B in FIG. 1, to be accepted. The moment exerted by the spring on the lever 46 in the clockwise direction must be greater than the moment that can be exerted in the counterclockwise direction by an impacting coin.

The inclined surface 55 has an angle X shown in FIGS. 6, 9 and 10, which directs the force P1 to a point within the range L. The actual distance from the normal to the inclined surface 55 at the point of impact of the coin 13, to the pivot point, multiplied by the force P1, is the moment generated by the coin.

If the normal lies in the region LA, the direction of the moment will be counterclockwise. If the normal lies in the region LB, the direction of the moment will be clockwise. If the normal coincides with the second pivot point 50, the ideal case, no moment is generated. A clockwise moment tends to drive the lever 46 against the mechanical stop 53, which prevents any further movement.

To prevent counterclockwise movement of the lever 46, the moment of the force P3 exerted by the spring 62 on the lever 46 must be greater than the counterclockwise moment. The maximum counterclockwise moment P5 will be P1LM, since LM is the farthest distance that the normal of the coin contact point to the inclined surface 55 can be from the second pivot 50 in the region LA. P5d, the moment of the spring 62, must therefore be greater than the moment P1LM, where "d" is the distance between the point on the lever 46 where the spring engages the lever, and the pivot point 55.

The moment P5d is also a force which must be overcome by the solenoid 36 when it is energized to move the actuator arm 32 and the lever 46 to their second, accept positions. The greater the force to be overcome, the greater the electrical power requirement of the solenoid 36. Therefore, P5d should be minimized. This is done in the present invention by choosing an angle X which restricts the counterclockwise moment generated by a falling coin 13 to a minimum value by directing the force Pl as close to the second pivot 50 as possible.

Another limitation on the angle X is the requirement that any clockwise moment generated by a normal in the region LB is not large enough to cause a rebound off of the mechanical stop 53, which could tend to drive the gate 46 to its second position In addition, if the angle X is too steep, a coin 13 could get wedged in between the inclined surface 55 and the inner wall 56a of the coin track 54. This would prevent the coin from rolling down the coin diverting plate 52 from point 52a to 52b, along path B, as shown in FIG. 1. It has been found that wedging becomes a problem between 35°–40°. In the preferred embodiment, an angle of 30° was chosen. This angle maintains the normal within a limited range and provides a sufficient tolerance.

In FIGS. 9–10, the coin 13 slides along the incline 55, until it impacts the inner surface 56a of the coin track 54, as shown in FIG. 10. The friction generated by sliding along the incline and the impact against the wall 56, dissipates kinetic energy from the coin 13, which prevents bouncing, and allows the coin to proceed down the coin diverting plate 52, from point 52a to 52b, and along coin path B, as shown in FIG. 1.

Returning to the details of the energization of solenoid 36, electrical current is connected to solenoid 36 through a pair of leads 112 and 114 connected to the two ends of energizing coil 360 respectively, as seen in FIG. 5. If gate 12 is to be employed in an application in which low power operational constraints do not apply, then any of a number of power supply and control circuits would be satisfactory, however, in the presently preferred embodiment, gate 12 is employed in a coin acceptor 10 which is to be employed in a pay telephone. Power for operation of gate 12 is taken from the phone line and is limited to approximately 20 mA when the phone is offhook. Consequently, special power supply circuitry and control circuitry are needed.

A suitable power supply circuit 150 and a control circuit 200 for use in the payphone environment are shown in FIGS. 7 and 8 respectively. A joint control circuit for controlling th coin acceptor 10 and a payphone incorporating that coin acceptor is disclosed in U.S. Pat. Application Serial No. 199,129 assigned to the assignee of the present invention, filed on May 26, 1988, the same date as the present application. The disclosure of this application identified immediately above is incorporated by reference herein.

Power is supplied to solenoid 36 of gate 12 as follows. A microprocessor 175 receives signals from the sensors 26, 28, and 30 as the coin 13 rolls past those sensors. If those signals correspond to those for an acceptable coin, the microprocessor 175 determines that solenoid 36 should be energized so that the coin 13 can be accepted. Power is supplied from the lead "SOL POWER" of power supply 150 of FIG. 7 to a first lead 112 of solenoid coil 360.

The power supply 150 is preferably composed of the following components connected as shown in FIG. 7:

| | |
|---|---|
| Resistors | |
| $R_{26}$, $R_{27}$, $R_{28A}$ | 100 |
| $R_{28}$ | 390 |
| Transistors | |
| $Q_3$ | IRFR902E |
| $Q_4$ | MMBD3984 |
| Schlottky Diode | |
| $D_{10}$ | 1N5818 |
| Capacitor | |
| $C_{46}$ | 100uF, 16V |

The power supply 150 is connected to a source of rectified TIP line voltage RECTIFIED TIP. The RECTIFIED TIP voltage is connected to resistor $R_{26}$ and the collector of transistor Q3. The microprocessor supplies a control signal U3CON, which is connected through resistor $R_{27}$, to the base of transistor $Q_4$. The level of the control signal U3CON determines whether transistor $Q_4$ is on or not on, and consequently determines the level of base current provided to transistor $Q_3$. This in turn determines the current passing from the TIP line through transistor $Q_3$, resistor $R_{28}$ and diode $D_{10}$ to charge the capacitor $C_{46}$. $R_{28A}$ is provided so that a trickle current maintains a charge on capacitor 46 after the initial charging. The SOL POWER line of FIG. 7 is connected to lead 112 of coil 360 as seen in FIG. 8.

The second lead 114 of coil 360 is connected to ground either through transistor $Q_{150}$ of FIG. 8 or through resistors $R_{151}$, $R_{153}$ and transistor $Q_{152}$ of FIG. 8 as determined by the signals on the GATE and GATE HOLD lines of control circuit 200. These signals are controlled by the microprocessor 175.

The control circuit 200 is preferably composed of the following components connected as shown in FIG. 8:

| | |
|---|---|
| Resistors | |
| $R_{150}$, $R_{151}$, $R_{153}$ | 1K |
| $R_{152}$ | 10K |
| $R_{154}$, $R_{155}$ | 22K |
| Capacitors | |
| $C_{14}$ | 47uF |
| $C_{70}$ | 4.7uF |
| $C_{150}$ | .1uF |
| Diode | |
| $D_{101}$ | 1N4148 |
| Transistors | |
| $Q_{150}$, $Q_{152}$ | BC847B |
| Inverters | |
| U10B, U10C | 74HCl4 |

Whenever the microprocessor 175 determines that a coin should be accepted, at the proper time the microprocessor 175 produces the necessary output to hold the GATE line low (0 volts). Consequently, the inverter U10C whose input is connected to the GATE line and through resistor $R_{154}$ to 5V produces a high (5V) output which drives the base of transistor $Q_{150}$ through resistor $R_{150}$. The base drive current turns transistor $Q_{150}$ on thereby connecting lead 114 of the solenoid coil 360 through the transistor $Q_{150}$ ground. When this occurs, the maximum drive current flows through coil 360.

In the presently preferred embodiment, a maximum drive current of approximately 50 mA is applied for about 80 milliseconds (ms) to insure that actuator arm 32 is fully and rapidly engaged so that magnetically attractable region 42 touches and is held against the insulating membrane 366 of FIG. 3. Once the actuator arm 32 is thus engaged, it is no longer necessary to apply the maximum drive current in order to hold actuator arm 32 in place. A much lower holding current is required, and consequently after approximately 80ms, the microprocessor returns the GATE line to 5V cutting off transistor $Q_{150}$. At the same time, the microprocessor 175 causes the GATE HOLD line to go from high to low. When the GATE HOLD line goes low, the invertor U10B, whose input is both connected to the GATE HOLD line and connected through resistor $R_{155}$ to 5V, produces a high output. This high output drives the base of transistor $Q_{152}$ through resistor $R_{152}$, turning on the transistor $Q_{152}$. When transistor Q152 is on, it effectively connects lead 114 of solenoid coil 360 to ground through the parallel connection of resistor $R_{151}$ and $R_{153}$ and the transistor $Q_{152}$. This path limits the current through coil 360 to approximately 20 mA. This holding current holds gate 12 in the accept position for a time long enough for the accepted coin to pass through slot 70. This hold time is preferably approximately 140 ms.

The charge well components, resistor R28 and capacitor C46, are selected to match their characteristics to the solenoid coil, thereby maximizing the energy transfer to the coil so as to save power. The values of these components are, therefore, dependent on the coil chosen for use in the solenoid.

By properly matching the power supply 150 and control 200 to the solenoid 36, a minimized amount of power is consumed to control gate 12. This is particularly important for operation from phone line supplied power.

We claim:

1. A compact, low power gate system for use in a coin operated machine to direct a coin along either of at least two coin paths, said system comprising;

a selectively energizable solenoid;

a means for controlling the selective energization of said solenoid;

an actuator arm having an upper and a lower part, said upper part having a magnetically attractable section proximate a pole of said solenoid;

a first pivot point between said upper and lower parts about which said actuator arm can rotate in response to the selective energization of said solenoid, said actuator arm having a first actuator arm position when said solenoid is not energized wherein said arm is positioned away from said solenoid and a second actuator arm position when said solenoid is energized wherein said arm is attracted to said solenoid;

a lever engaged by and adjacent to said lower part of said actuator arm, such that said arm and said lever are substantially overlapping, said lever having a pivot point at a first end, about which said lever can rotate, said lever moving from a first lever position to a second lever position due to the movement of said actuator arm from said first arm position to said second arm position;

a resilient means for restoring said lever and said actuator arm to their first positions when said solenoid is de-energized; and a coin diverting plate at a second end of said lever opposite said second pivot such that displacement of said first part of said actuator arm when attracted to said solenoid translates to a sufficient displacement of said coin diverting plate to direct a coin to either of said coin paths;

said plate having a first angle of inclination along said coin path and a second angle of inclination toward a side wall of said coin path for diverting said coin against said wall, dissipating its kinetic energy, said second angle of inclination directing a component of force perpendicular to said second angle of inclination toward said pivot point such that a moment generated by said component of force tending to rotate said coin diverting means against the direction of the force of the coin restoring means is less than a moment generated by said restoring means.

2. A compact, low power gate apparatus as in claim 1 wherein said coin diverting plate has an opening through which a coin can pass and said first lever position is a reject position wherein said coin diverting plate lies along said coin track to divert a coin and said second gate position is an accept position, wherein said opening in said gate is aligned with said coin track such that a coin passes through said gate.

3. A compact, low power gate apparatus as in claim 1 or claim 2 wherein said lever is engaged by an extension from said lower part of the actuator arm, said extension overlapping a portion of said lever, said engagement occurring between said diverting plate and said pivot point, such that when said solenoid is energized, said actuator arm is attracted by said solenoid, rotating about said first pivot from said first actuator arm position to said second actuator arm position and said extension of said actuator arm rotates said lever about said second pivot, from said first gate position to said second gate position, and when said solenoid is de-energized, said means for restoring said gate restores said gate to said first gate position, said gate pushing against said extension of said actuator arm, rotating said actuator arm about said first pivot, restoring said actuator arm to said first actuator arm position.

4. A compact, low power gate apparatus as in claim 3 wherein said restoring means is a spring engaging said lever, providing a restoring force in the direction of said first lever position.

5. A compact, low power gate apparatus as in claim 4 wherein said system further comprises a set screw above said upper part of said actuator arm, defining said arm's first position and preventing said arm from rotating beyond the most effective range of said solenoid.

6. A compact, low power gate apparatus as in claim 5, wherein said extension includes an adjustable set screw for engaging said lever.

7. A compact, low power gate apparatus as in claim 6 wherein said solenoid has a thin magnetic insulator covering its pole to prevent residual magnetism from retaining said actuator arm in said second position after said solenoid is de-energized.

8. A compact, low power gate apparatus as in claim 1 or 2 wherein said control means is a microprocessor.

9. A compact, low power gate apparatus as in claim 1 wherein said coin operated machine is a coin operated telephone and said gate apparatus fits within the available space for a conventional coin acceptor within said coin operated telephone, and said gate apparatus operates using only power supplied by a telephone line.

10. A compact, low power gate apparatus as in claim 1 wherein said lever is in contact with a mechanical stop when said lever is in said first lever position.

11. A compact, low power gate apparatus as in claim 10 wherein said inclined surface is at an angle of approximately 30°.

12. The apparatus of claim 1 wherein the control means for controlling the selective energization of said solenoid comprises a power supply which matches the solenoid.

13. The apparatus of claim 1 wherein the control means for controlling the selective energization of said solenoid comprises a control circuit for applying a first maximum solenoid drive current for a predetermined period of time and for applying a second reduced solenoid drive hold current for a second predetermined period of time.

14. The apparatus of claim 8 wherein said microprocessor further comprises a control circuit for applying a first maximum solenoid drive current for a predetermined period of time and for applying a second reduced solenoid drive hold current for a second predetermined period of time.

15. A gate apparatus as in claim 1 wherein said resilient means is a spring with a spring constant and a degree of compression adjusted so that the force exerted by said spring on said coin diverting means is sufficient to generate a moment greater than the moment which can be generated by said impacting coin in a direction opposite the force of said restoring means.

16. A gate apparatus as in claim 1 wherein said lever is engaged between its first and second end by said lower part of said actuator arm.

17. A compact, low power gate apparatus as in claim 1 wherein said coin diverting plate is proximate the upper part of said actuator arm attracted by said solenoid.

18. A compact, low power gate apparatus as in claim 1, wherein said coin operated machine includes sensors for testing said coins, and said coin diverting plate is proximate said sensors.

19. A gate apparatus for controlling the direction of travel of a coin moving along a coin path of a coin operated machine, said gate comprising, a coin diverting plate, a pivot, and a means for rotating said plate about said pivot;

said plate having a first angle of inclination along a coin path for directing said coin along said coin path; and a second angle of inclination toward a side wall of said coin path for diverting said coin against said wall, dissipating its kinetic energy, wherein said second angle of inclination directs a component of force due to an impact of a coin on said plate perpendicular to said second angle of inclination, toward said pivot point.

20. A gate apparatus as in claim 19, wherein said plate has an opening through which a coin can pass.

21. The gate of claim 19, wherein the second angle of inclination has an angle minimizing the moment generated by an impacting coin.

22. The gate of claim 19, wherein said first angle of inclination is approximately 30°.

23. The gate of claim 19, wherein the force perpendicular to said second angle of inclination is coincident with said pivot point.

24. The gate of claim 19 or 20, wherein said means for rotating said plate about said pivot comprises a lever means and a selectively energized solenoid, said lever means engaging said gate and said pivot and having a magnetic section which is attracted by said solenoid when said solenoid is energized, such that the selective energization of said solenoid causes the rotation of said lever about said pivot.

25. The gate of claim 24, having a first and second position along a coin path, said selective energization of said solenoid causing said gate to move from its first to its second position and wherein said gate further comprises a restoring means engaging said lever means for returning said gate from said second to said first position.

26. The gate of claim 25, wherein in said first position, said gate blocks said coin path to direct a coin along a second coin path, and in said second position, said opening aligns with said first coin path, allowing said coin to continue along said first coin path.

* * * * *

UNITED STATES PATENT AND TRADEMARK OFFICE

CERTIFICATE OF CORRECTION

PATENT NO. : 4,953,681

DATED : September 4, 1990

INVENTOR(S) : Zouzoulas

It is certified that error appears in the above—identified patent and that said Letters Patent is hereby corrected as shown below:

Column 4, line 68, delete "Coin" and insert --coin--.

Column 5, line 8, delete "!50" and insert --150--.

Column 5, line 21, delete "coil" and insert --coin--.

Column 5, line 57, delete "arm" and insert --part--.

Column 6, line 14, delete "arm 47".

Column 7, line 53, delete "ar" and insert --arm--.

Column 9, line 35, delete "th" and insert --the--.

Column 9, line 68, delete "Q3" and insert --$Q_3$--.

Column 10, line 58, insert --175-- following "microprocessor".

Signed and Sealed this

Tenth Day of November, 1992

*Attest:*

DOUGLAS B. COMER

*Attesting Officer*

*Acting Commissioner of Patents and Trademarks*

UNITED STATES PATENT OFFICE

CERTIFICATE OF CORRECTION

PATENT NO. : 4,953,681

DATED : September 4, 1990

INVENTOR(S) : Zouzoulas

It is certified that error appears in the above-identified patent and that said Letters Patent is hereby corrected as shown below:

Column 6, lines 23-24, delete the phrase "is also".

Column 7, line 16, insert --longer lever.-- following "one,".

Column 7, line 17, insert --A small displacement of the first part 40 of-- following "other".

Signed and Sealed this

Fifth Day of October, 1993

Bruce Lehman

*Attest:*

BRUCE LEHMAN

*Attesting Officer*

*Commissioner of Patents and Trademarks*